US006890393B2

(12) United States Patent
Buck

(10) Patent No.: US 6,890,393 B2
(45) **Date of Patent: *May 10, 2005**

(54) FINE-GRAINED MARTENSITIC STAINLESS STEEL AND METHOD THEREOF

(75) Inventor: Robert F. Buck, Trafford, PA (US)

(73) Assignee: Advanced Steel Technology, LLC, Trafford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/706,154

(22) Filed: Nov. 12, 2003

(65) Prior Publication Data

US 2004/0154707 A1 Aug. 12, 2004

Related U.S. Application Data

(63) Continuation-in-part of application No. 10/431,680, filed on May 8, 2003.
(60) Provisional application No. 60/445,740, filed on Feb. 7, 2003.

(51) Int. Cl.[7] ..... C22C 38/50; C22C 38/44; C21D 8/10; C21D 8/00

(52) U.S. Cl. ..... 148/325; 148/333; 148/660; 148/663; 148/593; 148/592

(58) Field of Search ..... 148/333, 325, 148/660, 663, 592, 593

(56) References Cited

U.S. PATENT DOCUMENTS

| | | | |
|---|---|---|---|
| 2,132,877 | A | 11/1936 | Naumann |
| 2,283,916 | A | 9/1940 | Comstock |
| 2,397,997 | A | 4/1946 | Wyche et al. |
| 2,597,173 | A | 2/1951 | Patterson |
| 2,469,887 | A | 5/1952 | Olcott |
| 2,693,413 | A | 11/1954 | Kirby et al. |
| 2,745,739 | A | 5/1956 | Phillips et al. |
| 2,747,989 | A | 5/1956 | Kirby et al. |
| 2,793,113 | A | 5/1957 | Ralt et al. |
| 2,848,323 | A | 8/1958 | Harris et al. |
| 2,905,577 | A | 9/1959 | Harris et al. |

(Continued)

FOREIGN PATENT DOCUMENTS

| | | |
|---|---|---|
| AU | 242854 | 10/1962 |
| CA | 2233117 | 9/1998 |
| DE | 1 212 306 | 3/1966 |
| DE | 2148421 | 4/1972 |
| FR | 1 177 028 | 4/1959 |
| FR | 2 700 174 | 7/1994 |
| GB | 678616 | 9/1952 |
| GB | 836026 | 6/1960 |
| GB | 883024 | 11/1961 |
| GB | 986061 | 1/1962 |
| GB | 918621 | 2/1963 |
| GB | 921838 | 3/1963 |
| GB | 976735 | 12/1964 |
| JP | 50-7528 | 3/1975 |
| JP | 51-2615 | 1/1976 |
| JP | 55-079857 | 6/1980 |
| JP | 55-110758 | 8/1980 |
| JP | 55-134159 | 10/1980 |
| JP | 60-029448 | 2/1985 |
| WO | WO 02/18666 | 3/2002 |

OTHER PUBLICATIONS

"Heat–Resistant Steels for Advanced" by Toshio Fujita, Professor Emeritus, University of Tokyo, Tokyo, Japan—Advanced Materials and Processes of Apr. 1992 (p. 42 through 47).

"Physical Chemistry of the Groups IVa. (Ti, Zr), Va (V, Nb, Ta) and the Rare Earth Elements in Steel" by Kiichi Narita—Transactions ISIJ, vol. 15, 1975 (p. 145 through 152).

*Primary Examiner*—Deborah Yee

(57) ABSTRACT

An iron based, fine-grained, alloy.

32 Claims, 3 Drawing Sheets

U.S. PATENT DOCUMENTS 3,152,934 A 10/1964 Lula et al.
3,154,412 A 10/1964 Kasak et al.
3,251,683 A 5/1966 Hammond
3,288,611 A 11/1966 Lula et al.
3,291,655 A 12/1966 Gill et al.
3,365,343 A 1/1968 Vordahl
3,539,338 A 11/1970 Mimino et al.
3,660,176 A * 5/1972 Denhard, Jr. ..... 148/565
3,661,658 A 5/1972 Oda et al.
3,677,744 A 7/1972 Yamamura et al.
4,090,813 A 5/1978 Minato et al.
4,405,369 A 9/1983 Otogura et al.
4,564,392 A 1/1986 Ohhashi
4,640,722 A 2/1987 Gorman
4,799,972 A 1/1989 Masuyama et al.
4,846,904 A 7/1989 Arai et al.
4,857,120 A 8/1989 Watanabe et al.
4,917,738 A 4/1990 Takano et al.
5,049,210 A 9/1991 Miysaka et al.
5,069,870 A 12/1991 Iseda et al.
5,102,619 A 4/1992 Garrison et al.
5,116,571 A 5/1992 Abe et al.
5,310,431 A 5/1994 Buck et al.
5,383,983 A 1/1995 Kondo et al.
6,030,469 A * 2/2000 Ernst et al. ..... 148/325
6,440,236 B1 8/2002 Hiramatsu et al.
6,475,307 B1 11/2002 Nystrom et al.
6,709,534 B2 * 3/2004 Kusinski et al. ..... 148/320
6,733,601 B2 * 5/2004 Yazawa et al. ..... 148/325

* cited by examiner

FINE-GRAINED MARTENSITIC STAINLESS STEEL AND METHOD THEREOF

CROSS REFERENCE TO RELATED APPLICATIONS

This application is a continuation-in-part of U.S. utility application Ser. No. 10/431,680, filed on May 8, 2003, which claimed the benefit of the filing date of U.S. provisional application Ser. No. 60/445,740, filed on Feb. 7, 2003, the disclosures of which are incorporated herein by reference.

FIELD OF THE INVENTION

The present exemplary embodiments relate to an iron based, fine-grained, martensitic stainless steel made using thermal mechanical treatment and strengthened with a relatively uniform dispersion of coarsening-resistant, MX-type precipitates.

BRIEF DESCRIPTION OF THE TABLES AND DRAWINGS

Table I lists the chemistry of heat #1703 and heat #4553, from which steel samples from each heat were hot worked.

Table II gives the mechanical properties of steel samples from heat #1703 and heat #4553.

DETAILED DESCRIPTION OF THE ILLUSTRATIVE EMBODIMENTS

Figure 1:
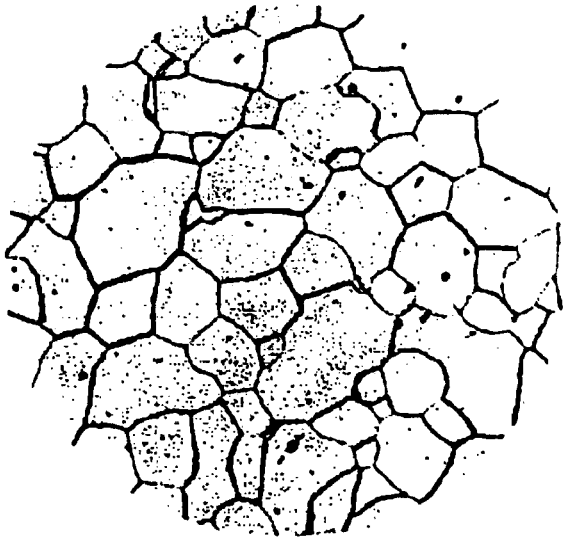
FIG. 1 is a reference microstructure (Nital etch) showing the nominal ASTM grain size No. 5. The image is magnified at 100×.

The illustrative embodiments provide an iron based, fine-grained, martensitic stainless steel made using thermal mechanical treatment and strengthened with a relatively uniform dispersion of coarsening-resistant, MX-type precipitates. A nominal composition is (wt. %): $0.05<C<0.15$; $7.5<Cr<15$; $1<Ni<5$; $0.01<Ti<0.75$; $0.135<(1.17Ti+0.6Zr+0.31Ta+0.31Hf)<1$; $Co<10$; $(Mo+W)<4$; $V<2$; $Nb<1$; $Mn<5$; $Al<0.2$; $Si<1.5$; $(Al+Si)>0.01$; $Cu<5$; $N<0.05$; $S<0.03$; $P<0.1$; $B<0.1$; and the balance essentially iron and impurities.

Conventional martensitic stainless steels usually contain 10.5% to 13% chromium and up to 0.25% carbon. Precipitation hardening martensitic stainless grades contain up to 17% chromium. Chromium, when dissolved in solid solution, provides the corrosion resistance characteristic of stainless steels. Many martensitic stainless steels also contain (i) ferrite stabilizing elements such as molybdenum, tungsten, vanadium, and/or niobium to increase strength; (ii) austenite stabilizing elements such as nickel and manganese to minimize delta ferrite formation and getter sulfur, respectively; and (iii) deoxidizing elements, such as aluminum and silicon. Copper is sometimes present in precipitation hardening martensitic stainless grades.

Conventional martensitic stainless steels are usually hot worked to their final shape, then heat treated to impart combinations of mechanical properties, e.g., strength and toughness within limited attainable ranges. Typical heat treatment of conventional martensitic stainless steels involves soaking the steel between ~950° C. and ~1100° C. and air cooling ("normalizing"), oil quenching, or water quenching to room temperature. Subsequently, the steel is usually tempered between 550° C. and 750° C. Tempering of conventional martensitic stainless steels results in the precipitation of nearly all carbon as chromium-rich carbides (i.e., $M_{23}C_6$) and other alloy carbides (e.g., $M_6C$), which generally precipitate on martensite lath boundaries and prior austenite grain boundaries in the body-centered-cubic or body-centered-tetragonal ferrite matrix. ("M" represents a combination of various metal atoms, such as chromium, molybdenum and iron.)

In 12–13% Cr steels, approximately 18 of the 23 metal atoms in $M_{23}C_6$ particles are chromium atoms. Thus, for every 6 carbon atoms that precipitate in $M_{23}C_6$ particles, approximately 18 chromium atoms also precipitate (a carbon to chromium atomic ratio of 1:3). The volume fraction of $M_{23}C_6$ precipitates scales with the carbon content. Therefore, in a 12% Cr steel with 0.21 wt. % carbon (which equals approximately 1 atom % carbon), about 3 wt. % chromium (~3 atom % chromium) precipitates as $M_{23}C_6$ particles, leaving an average of about 9 wt. % chromium dissolved in solid solution in the matrix. If this material were tempered at a relatively high temperature, the chromium remaining in solid solution (~9%) would be uniformly distributed in the matrix due to thermal atomic diffusion. However, if the tempering temperature is relatively low and diffusion is sluggish, regions surrounding the $M_{23}C_6$ precipitates will contain less chromium than regions further away from the particles. This heterogeneous distribution of chromium in solid solution is known as sensitization and can cause accelerated localized corrosion in chromium-lean areas immediately surrounding the $M_{23}C_6$ particles. To preclude sensitization of conventional 12% Cr steels with relatively high carbon contents, high tempering temperatures are used. However, the yield strength (0.2% offset) of conventional martensitic stainless steels is reduced after tempering at high temperatures—generally to less than 760 MPa, which may not be desirable.

Several martensitic stainless steels have been developed that contain low levels of carbon (<0.02 wt. %) and relatively high amounts of nickel and other solid solution strengthening elements, such as molybdenum. Although these low carbon martensitic stainless steels are not generally susceptible to sensitization, they can be heat treated to yield strengths only up to about 900 MPa. Moreover, the cost of these steels is relatively high, primarily because of the large amounts of expensive nickel and molybdenum in them.

In the present exemplary embodiments, an iron based alloy is provided, having greater than 7.5% chromium and less than 15% Cr, and in an exemplary embodiment having 10.5–13% Cr, which when acted upon with a thermal mechanical treatment according to the present invention has fine grains and a superior combination of tensile properties and impact toughness. The outstanding mechanical properties of the steel of the present invention are believed to be largely attributable to the fine grain size and also the coarsening resistance of the small, secondary MX particles. These microstructural features are caused to result from the combination of the chemical composition of the alloy and the thermal mechanical treatment. Appropriate alloy composition and thermal mechanical treatment are both chosen such that the majority of the interstitial solute (mostly carbon) is in the form of secondary MX particles.

It will be understood in metallurgical terms that for an MX particle, M represents metal atoms, X represents interstitial atoms, i.e., carbon and/or nitrogen, and that the MX particle could be a carbide, nitride or carbonitride particle. Generally, there are two types of MX particles: primary (large or coarse) MX particles and secondary (small or fine) MX particles. Primary MX particles in steel are usually greater than about 0.5 $\mu$m (500 nm) and secondary (small or fine) MX particles are usually less than about 0.2 $\mu$m (200 nm). The conditions under which different metal atoms form MX particles vary with the composition of the steel alloy.

In the present exemplary embodiments, small secondary MX particles are in an exemplary embodiment formed (where M=Ti, Nb, V, Ta, Hf, and/or Zr, and X=C and/or N). In the present exemplary embodiments, it has been found that there are certain advantages of forming MX particles using Ti versus other possible strong carbide forming elements. One metallurgical advantage of adding a relatively large amount of titanium to the steel (versus other strong carbide forming elements) is that sulfur can be gettered in the form of titanium carbo-sulfide ($Ti_4C_2S_2$) particles rather than manganese sulfide (MnS) particles. Because titanium carbo-sulfides are known to be more resistant to dissolution in certain aqueous environments than are manganese sulfides, and because dissolution of MnS particles located on the surface results in pitting, the pitting resistance of the steel of the current exemplary embodiments is increased if sulfur inclusions are present as titanium carbo-sulfides rather than manganese sulfides. Additionally, use of titanium minimizes the cost of the steel because titanium is less expensive than niobium, vanadium, tantalum, zirconium and halfnium. Use of titanium is preferred to that of vanadium because the resultant titanium carbide particles have greater thermodynamic stability than vanadium carbide particles and therefore are more effective at pinning grains at high hot working temperatures which ultimately leads to better mechanical properties.

In the steel of the current exemplary embodiments, recrystallization and precipitation of fine, MX particles are caused to occur essentially simultaneously or at nearly the same time during the process of thermal mechanical treatment. According to the exemplary embodiments the thermal mechanical treatment includes soaking the steel at the appropriate austenitizing temperature to dissolve most of the MX particles, and hot working it while at a temperature at which secondary MX precipitation and recrystallization will both occur because of the imposed strain, hot working temperature, and balanced chemistry. It has been found for the alloy composition of the present exemplary embodiments that this unique condition occurs at temperatures above about 1000° C. provided a true stain of at least 0.15 (15%) is applied mechanically. If insufficient strain is imposed and/or the hot deformation is not applied at a high enough temperature, MX precipitation may still occur, but full recrystallization will not. It has been found that by producing a sufficiently large volume fraction and number density of fine MX precipitates at or about the same time that recrystallization is initiated, grain growth during and after subsequent hot working is also limited. The grains are recrystallized into small, equiaxed grains and the fine, secondary MX precipitates inhibit grain growth so that small, equiaxed grains are retained to a great extent in the final product. It has been found that fine grain size (in which the ASTM grain size number is 5 or greater) provides good mechanical properties to the resulting steel and can be obtained according to the present exemplary embodiments. The chemical composition of the alloy is designed to produce a large volume fraction and number density of the fine MX particles as precipitates in the alloy when it is thermal mechanically treated according to the exemplary embodiments. The precipitates that form during and after hot working are secondary precipitates rather than the large undissolved primary particles that may be present during austenization.

The steel of the current exemplary embodiments is significantly different from conventional martensitic stainless steels in several ways. First, the second phase particles used to strengthen the steel are the MX-type (NaCl crystal structure) rather than chromium-rich carbides such as $M_{23}C_6$ and $M_6C$. Second, the secondary MX particles formed in the present exemplary embodiments generally precipitate on dislocations and result in a relatively uniform precipitate dispersion. Conversely, in conventional martensitic stainless steels precipitates generally nucleate and grow on prior austenite boundaries and martensite lath boundaries during tempering. As such, precipitate dispersions in conventional martensitic steels are more heterogeneous than the relatively uniform precipitate dispersions created in the steel of the current exemplary embodiments. Third, the small MX particles limit growth of newly-formed (recrystallized) grains during the thermal mechanical treatment according to the present exemplary embodiments. Finally, unlike conventional martensitic stainless steel, the steel of the current exemplary embodiments (after proper thermal mechanical treatment) can be subsequently austenitized at relatively high soaking temperatures without excessive grain growth because the MX particles do not coarsen or dissolve appreciably at intermediate temperatures (up to 1150° C.). If most conventional martensitic stainless steels were austenitized at 1150° C., excessive grain growth would occur. It is important to note that because creep strength in steels generally decreases with decreasing grain size, the creep strength of the steel of the current exemplary embodiments, due to its fine grain size, is not expected to be as high as it might be if the grain size were large.

In a prior U.S. Patent (No. 5,310,431) issued to the present inventor, which is incorporated herein by reference, a creep resistant precipitation dispersion strengthened martensitic stainless steel was disclosed. Although the chemical composition of the prior alloy overlaps some of the composition ranges disclosed for the present exemplary embodiments, the purpose and teachings of the prior patent were to maximize creep strength. It will be understood that creep strength is generally increased by large grains and decreased by small grains. The prior patent disclosed, in one embodiment, the use of hot working at selected temperatures below the recrystallization temperature for the purpose of increasing the dislocation density, which would provide intragranular nucleation sites for MX particles. Hot working below the recrystallization temperature would not result in fine, recrystallized, equiaxed grains, but rather would merely change the aspect ratio of the grains (flatten them slightly) and result in improved creep strength of the existing large-grained microstructure. Other, prior creep resistant stainless steel alloys followed the same wisdom of using relatively large grains, but with carbides formed at the grain boundaries to a greater or lesser extent.

The steel of the current exemplary embodiments may be used in such industrial applications as tubing for the oil and gas industry as well as for bars, plates, wire and other products that require a combination of excellent mechanical properties and good corrosion resistance.

It has been found according to the present exemplary embodiments that by properly applying the specified thermal mechanical treatment (TMT) to the martensitic stainless steel having a carefully balanced composition, a fine-grained microstructure is created that results in good tensile properties at room temperature, high impact toughness at low temperature, and good corrosion resistance at elevated temperatures. (Because of the fine grain size, however, creep strength is expected to be lower than similar martensitic steel compositions that are not thermal mechanically treated according to the exemplary embodiments.) For purposes of the present exemplary embodiments, the chemistry of the martensitic stainless steel should be balanced so as to: (i) provide adequate corrosion resistance, (ii) prevent the formation of delta ferrite at high austenitizing temperatures, (iii) preclude the presence of retained austenite at room temperature, (iv) contain sufficient amounts of carbon and strong carbide forming elements to precipitate as MX-type particles, (v) be sufficiently deoxidized, and (vi) be relatively clean (minimize impurities). The thermal mechanical treatment according to the exemplary embodiments should be applied at sufficiently high temperatures and true strains so that (i) the microstructure recrystallizes resulting in small equiaxed grains, and (ii) the dislocation density is increased, thereby providing MX particle nucleation sites. The design of the steel chemistry and the thermal mechanical treatment will be explained in greater detail below.

Careful selection of elements from the following six groups facilitates the desired results:

1. Strong Carbide/Nitride Forming Elements (Ti, Nb, V, Hf, Zr, and Ta).

These elements are used for their carbide forming properties. Because these elements also form nitrides, however, efforts are made to provide a chemical composition for the alloy that limits nitride formation.

Not all of the strong carbide forming elements are equal in terms of their cost, availability, effect on non-metallic inclusion formation, or the thermodynamic stability of their respective carbides, nitrides and/or carbo-nitrides. Given these considerations, it has been found that titanium is the preferred strong carbide forming element. Note, however, that Ta, Zr, and Hf (although more expensive than Ti) also form MX particles with high thermodynamic stability and therefore, if used in appropriate quantities, could be used without departing from certain aspects of the exemplary embodiments. The elements V and Nb are not as desirable as Ti because both elements are more expensive than Ti. Additionally, vanadium forms carbides and nitrides that are not as thermodynamically stable as are titanium carbides and nitrides, respectively, and niobium does not getter sulfur as a desirable inclusion as titanium does in the form of $Ti_4C_2S_2$.

Part of the thermal mechanical treatment involves soaking the alloy at an elevated temperature prior to mechanically straining the alloy by hot working. There are two objectives during soaking prior to such hot working: (i) most of the strong carbide/nitride forming elements should be dissolved in solid solution, and (ii) the temperature should be high enough throughout the material so as to facilitate the recrystallization of the microstructure during hot working. The soaking temperature should be approximately the MX dissolution temperature, which depends on the amounts of M (strong carbide forming metal atoms), and X (C and/or N atoms) in the bulk alloy. The amount of undissolved primary MX particles should be minimized to achieve the best mechanical properties. Such minimization has been considered in connection with designing the chemical composition of the alloy. The steel should be kept at the soaking temperature for a time period sufficient to result in a homogeneous distribution of the strong carbide forming element(s). The desired atomic stoichiometry between strong carbide forming elements and interstitial solute elements (carbon and nitrogen) should be 1:1 to promote formation of MX precipitates. It is noted that generally, nitride formation is not preferred and the chemical composition is designed to minimize nitride formation without undue cost.

To achieve the desired strength level and volume fraction of secondary MX particles, the total amount of Ti and other strong carbide forming elements (zirconium, tantalum, and hafnium) should range from greater than 0.135 atom % to less than 1.0 atom %. If the amount of strong carbide forming elements Ti, Zr, Ta, and Hf is less than 0.135 atom %, the MX volume fraction would not effectively pin the newly-formed grains after recrystallization. The metallurgical term "pin" is used to describe the phenomenon whereby particles at a grain boundary sufficiently reduce the energy of the particle/matrix/boundary "system" to resist migration of the grain boundary and thereby hinder grain growth. Thus, it is found that a sufficiently high MX volume fraction will reduce grain growth kinetics during and after recrystallization. If the amount of strong carbide forming elements Ti, Zr, Ta, and Hf is greater than 1 atom %, however, the volume fraction of primary MX particles is relatively high and leads to degraded mechanical properties. At least 0.01 wt. % titanium should be present to getter sulfur as $Ti_4C_2S_2$. Furthermore, titanium should be restricted to less than 0.75 wt. % to minimize the formation of primary MX particles. At Ti levels in excess of 0.75 wt. %, ingot surface quality would be expected to be poor (rough). One can estimate the atom percentages of titanium, zirconium, tantalum, and halfnium by multiplying the weight percentages of each element by the following multiples: 1.17 (Ti), 0.6 (Zr), 0.31 (Ta), and 0.31 (Hf), respectively.

If vanadium and niobium (also known as columbium) are present, V should be limited to less than 2 wt. %, and Nb should be limited to less than 1 wt. % to prevent delta ferrite formation.

2. Interstitial Solute Elements (C and N).

The amount of carbon and nitrogen depends upon the amount of strong carbide (and nitride) forming elements present and should approximate an M:X atomic stoichiometry of 1:1. Because of the presence of titanium, zirconium, niobium, halfnium or tantalum, the nitrogen content should be kept low to minimize the formation of primary nitride particles (inclusions), which do not dissolve appreciably even at very high soaking temperatures. From a cost-benefit standpoint, it has been found that a small amount of N can be tolerated in the alloy without undue degradation of the mechanical properties. For that reason nitrogen content should be limited to 0.05 wt. %, and should in an exemplary embodiment be limited to less than 0.02 wt. %. To achieve the minimum desired volume fraction of secondary MX particles, at least greater than 0.05 wt. % carbon should be present. However, to prevent excessive formation of primary MX particles, the carbon content should be limited to less than 0.15 wt. % and nitrogen content should be limited to less than 0.05 wt. %, as indicated above.

3. Non-Carbide Forming, Austenite Stabilizing Elements (Ni, Mn, Co, and Cu) and Ferrite Stabilizing Elements (Si, Mo, and W).

Sufficient amounts of austenite stabilizing elements should be present to maintain the structure fully austenitic during soaking (austenitizing), thereby minimizing or precluding the simultaneous presence of delta ferrite.

Nickel is the primary non-precipitating austenite stabilizing element added to minimize delta ferrite formation, whereas manganese is present as a secondary, non-precipitating, austenite stabilizing element. (In conventional steels, Mn also getters sulfur.) Both nickel and manganese markedly reduce the Ac1 temperature. Ferrite-stabilizing elements such as molybdenum, tungsten, and silicon serve several purposes in the steel, including raising the Ac1 temperature and increasing the strength by solid solution strengthening. Moreover, molybdenum increases the pitting resistance of the steel in certain environments, while silicon enhances corrosion resistance and is a potent deoxidizer.

The Ac1 temperature (also known as the lower critical temperature) is the temperature that, upon heating from room temperature, steel with a martensitic, bainitic, or ferritic structure begins to transform to austenite. Generally, the Ac1 temperature defines the highest temperature at which the steel can be tempered. Austenite stabilizing elements usually lower the Ac1 temperature, while ferrite stabilizing elements generally raise it. Because there are certain circumstances in which it would be desired to temper the steel at a relatively high temperature (during post weld heat treating, for example, where weldment hardness should be limited), it is preferred to maintain the Ac1 temperature to be relatively high for the steel of the present exemplary embodiments. Creating a microstructure that is free of delta ferrite is also desirable for purposes of the exemplary embodiments.

The Ac1 temperature and the presence of delta ferrite are primarily determined by the balance of ferrite stabilizing elements and austenite-stabilizing elements in the steel. Therefore, not only should the proper overall balance between austenite-stabilizing elements and ferrite-stabilizing elements be met, but limits on individual elements should also be established as given below if the Ac1 temperature is to remain relatively high while the formation of delta ferrite is to be minimized or avoided.

At least 1 wt. % nickel and in an exemplary embodiment at least greater than 2 wt. % nickel should be present to prevent formation of delta ferrite. However, the amount of nickel and manganese should each be limited to less than 5 wt. % because both elements markedly reduce the Ac1 temperature. Similarly, cobalt should not exceed 10 wt. % and in an exemplary embodiment should be less than 4 wt. %, while copper should be limited to 5 wt. % and in an exemplary embodiment less than 1.2 wt. % because both Co and Cu reduce the Ac1, albeit to a lesser degree than does Ni and Mn. Addition of too much ferrite stabilizing elements would promote delta ferrite formation and hence, degrade mechanical properties. Therefore, the sum of molybdenum plus tungsten should be limited to 4 wt. %, while silicon should not exceed 1.5 wt. % and in an exemplary embodiment should not exceed 1 wt. %.

4. Corrosion Resistance (Cr).

For good resistance to corrosion from carbon dioxide ($CO_2$) dissolved in aqueous solutions (carbonic acid) as well as atmospheric corrosion, the steel should contain the appropriate amount of chromium. General corrosion resistance is typically proportional to the chromium level in the steel. A minimum chromium content of greater than about 7.5 wt. % is desirable for adequate corrosion resistance. However, to maintain a structure that is free of delta ferrite at soaking temperatures, chromium should be limited to 15 wt. %.

5. Impurity Getterers (Al, Si, Ce, Ca, Y, Mg, La, Be, B, Sc).

Appropriate amounts of elements to getter oxygen should be added including aluminum and silicon. The use of titanium in the alloy of the present exemplary embodiments makes Al a desirable oxygen getterer. Rare earth elements cerium and lanthanum may also be added, but are not necessary. Therefore, the sum of aluminum plus silicon should be at least 0.01 wt. %. The total amount of Al should be limited to less than 0.2 wt. %, while cerium, calcium, yttrium, magnesium, lanthanum, boron, scandium, and beryllium should each be limited to less than 0.1 wt % otherwise mechanical properties could be degraded.

6. Impurities (S, P, Sn, Sb, Pb, O).

To maintain adequate toughness and a good combination of mechanical properties, sulfur should be limited to less than 0.03 wt. %, phosphorus limited to less than 0.1 wt. %, and all other impurities including tin, antimony, lead and oxygen should each be limited to less than 0.04 wt. %.

Thermal Mechanical Treatment

The purpose of the thermal mechanical treatment is to recrystallize the microstructure during hot working and precipitate a uniform dispersion of fine MX particles to pin the boundaries of the newly-recrystallized grains such that a fine-grained, equiaxed microstructure is obtained after cooling to room temperature. In order to successfully implement the thermal mechanical treatment, the recrystallization kinetics should be rapid enough such that complete or near complete recrystallization occurs during the hot working process. Generally, recrystallization kinetics are more rapid at higher temperatures than at lower temperatures. If recrystallization is relatively sluggish for a given amount of hot work imparted to the steel, the subsequent grain morphology will be "pancaked" (large aspect ratio) and mechanical properties will be degraded for the present purposes. Note that the thermal mechanical treatment taught herein is contrary to the purpose of increasing creep strength as indicated above. Upon obtaining equiaxed fine grains after recrystallization, the small grains should be prevented or hindered from growing appreciably upon cooling to room temperature. The steel of the current exemplary embodiments achieves this objective through the precipitation of fine MX particles during hot working. By doing so, the small equiaxed grain structure formed during hot working is retained to lower temperatures. Thus, the combination of the chemical composition that provides precipitation of fine MX particles and the thermal mechanical treatment are uniquely combined to create a fine grain martensitic stainless steel. Because the MX particles are coarsening-resistant, after the steel is cooled to room temperature, it can be reheated (austenitized) to temperatures up to 1150° C. without appreciable grain growth. After the fine-grained microstructure has been created through thermal mechanical treatment, the steel of the current exemplary embodiments retains its good combination of tensile properties and toughness even when reaustenitized at relatively high temperatures and after it is tempered. Additional details of a preferred embodiment of the thermal mechanical treatment according to one aspect of the present exemplary embodiments are described below.

It has been found that recrystallization kinetics for the present alloy are primarily determined by three hot working parameters: deformation temperature, starting austenite grain size, and true strain of deformation. Other factors, including strain rate, have been found to have less influence and it may be considered that they do not appreciably influence recrystallization kinetics. In the steel of the present exemplary embodiments, the starting austenite grain size is primarily determined by the soaking temperature and soaking time, and the amount of strong carbide and nitride forming elements present.

If conventional martensitic stainless steels are hot worked at a high enough temperature and great enough true strain, recrystallization will occur. (If the temperature is not high enough, or the strain is not great enough, or the starting grain size is too large, then pancaking will result). The newly-formed recrystallized grains then grow in size; the higher the hot working temperature, the faster the grain growth. In conventional martensitic stainless steels it has been found that grain growth occurs when the volume fraction of fine, second phase particles is too small to effectively pin the growing grains.

The steel of the current exemplary embodiments is significantly different from conventional martensitic stainless steels in that grain growth after recrystallization is limited due to the induced presence of small, secondary, MX particles that precipitate during hot working. In general, I have found that it is necessary for the temperature to be greater than about 1000° C. and the true strain to be greater than about 15% (0.15) for recrystallization to occur within a reasonable time frame (for a typical starting austenite grain size), and for the dislocation density to be great enough to facilitate precipitation of secondary MX particles.

Therefore, a method of creating a fine-grained martensitic stainless steel with good mechanical properties has been disclosed that involves: (i) choosing the appropriate amount of carbon and strong carbide forming element(s) to provide a sufficient volume fraction and number density of MX precipitates to effectively pin newly-formed grains during and after recrystallization; (ii) balancing the amounts of non-precipitating austenite and ferrite stabilizing elements to maintain an austenite structure at high temperatures that is transformable to martensite at room temperature (without retained austenite or delta ferrite); (iii) adding the appropriate amount of chromium for adequate corrosion resistance; (iv) adding sufficient quantities of deoxidizing elements and impurity gettering elements; (v) recrystallizing the microstructure to create a fine grain size; (vi) precipitating fine MX particles by thermal mechanical treatment; and (vii) cooling the stainless steel to room temperature.

EXAMPLE 1

Based on these considerations, in an exemplary embodiment, an iron based alloy with a fine grain size having good corrosion resistance with high strength and toughness is provided having the composition (wt. %):

| | |
|---|---|
| C | 0.05 < C < 0.15 |
| Cr | 7.5 < Cr < 15 |
| Ni | 1 < Ni < 5 |
| Co | Co < 10 |
| Cu | Cu < 5 |
| Mn | Mn < 5 |
| Si | Si < 1.5 |
| W, Mo | (W + Mo) < 4 |
| Ti | 0.01 < Ti < 0.75 |
| Zr | Zr < 1.6 |
| Ta | Ta < 3.2 |
| Hf | Hf < 3.2 |
| Ti, Zr, Ta, Hf | 0.135 < (1.17Ti + 0.6Zr + 0.31Ta + 0.31Hf) < 1 |
| Nb | Nb < 1 |
| V | V < 2 |
| N | N < 0.05 |
| Al | Al < 0.2 |
| Al, Si | (Al + Si) > 0.01 |
| B, Ce, Mg, Sc, Y, La, Be, Ca | <0.1 (each) |
| P | <0.1 |
| S | <0.03 |
| Sb, Sn, O, Pb | <0.04 (each) |
| and, with other impurities, the balance essentially iron. | |

In order to create a fine-grained microstructure, according to one embodiment of the exemplary embodiments, the alloy is thermal mechanically treated. An exemplary embodiment of the thermal mechanical treatment includes soaking the alloy in the form of a 15 cm thick slab at 1230° C. for 2 hours such that the structure is mostly face-centered-cubic (austenite) throughout the alloy. The slab is then hot worked on a reversing rolling mill at a temperature between 1230° C. and 1150° C. during which time a true strain of 0.22 to 0.24 per pass is imparted to recrystallize the microstructure. The resulting plate is then air-cooled to room temperature so that it transforms to martensite. The thermal mechanical treatment given above and applied to the indicated alloy resulted in a fine grain, fully martensitic microstructure in which the ASTM grain size number is greater than or equal to 5. For reference, a sample ASTM grain size No. 5 is shown in FIG. 1.

FIG. 1 shows a reference illustration of nominal ASTM grain size No. 5. The specimen shown (Nital etch; image magnification: 100×) has a calculated grain size No. of 4.98.

The ASTM grain size number can be calculated as follows:

$$N(0.01\text{ in})^2 = N(0.0645\text{ mm}^2) = 2^{n-1}$$

where 'N' is the number of grains observed in an actual area of 0.0645 $mm^2$ (1 $in.^2$ at 100× magnification) and 'n' is the grain-size number. [Note: a 1 in.×1 in. area at 100×=0.0001 $in^2$=0.0645 $mm^2$.]

The hot working aspect of the thermal mechanical treatment as described may be applied through various methods including the use of conventional rolling mills to make bar, rod, sheet and plate, open-die, closed-die or rotary forging presses and hammers to make forged components, and Mannesmann piercing, multi-pass, mandrel and/or stretch reduction rolling mills used to manufacture seamless tubes and pipes. In all of these operations, it is preferred to impart a relatively large and uniform amount of true strain to the work piece while it is hot. Although the work piece may be repeatedly hot worked as it cools, hot working should stop when the temperature decreases below about 1000° C., otherwise pancaking may occur and mechanical properties may be degraded. After thermal mechanical treatment, the alloy may be subsequently heat treated. For purposes of this patent application, the term "heat treatment" as used herein is not the same as the thermal mechanical treatment described above. Rather, "heat treatment" refers to a process applied after the component has been formed, namely after it has been thermal mechanically treated and cooled to a temperature below the martensite finish temperature to form a fine-grained martensitic stainless steel product. Specifically, heat treatment of the steel may include tempering; austenitizing, quenching and tempering; normalizing and tempering; normalizing; and austenitizing and quenching. It should be understood that in order to manufacture a commercial product utilizing the technology disclosed herein, product quality issues, such as surface quality and dimensional tolerance, should also be adequately addressed.

EXAMPLE 2

A second example is given below in which two heats with similar compositions were given different thermal mechanical treatments. The composition of each heat is given in Table 1. Heat #1703 was rolled into round bar, while heat #4553 was forged into round bar; each process used a different thermal mechanical treatment. Less than about 15% true strain was used during hot working passes to produce bar made from heat #4553, while the bar made from heat #1703 was rolled using greater than about 15% true strain. It will be understood that true strain, $\epsilon$, is defined as In ($L/L_0$), where 'L' is the length after hot working and '$L_0$' is the length before hot working (the original length). Similarly, one can use cross sectional area to calculate the true strain. In this case, $\epsilon$=In ($A_0/A$), where 'A' is the cross sectional area after hot working, '$A_0$' is the cross sectional area before hot working, and $A=(A_0L_0)/L$ if the deformation is uniform and assuming plastic deformation occurs at constant volume. For example, if the cross sectional area of a work piece is 10 $cm^2$ before rolling and 8 $cm^2$ after a rolling pass, a true strain of In (10/8)=0.223 (22.3%) would have been imparted. The mechanical properties of both steel samples were determined and are given in Table 2. Whereas both sample bars have approximately the same yield strength, ultimate tensile strength and elongation, heat #1703 exhibits much greater Charpy V-notch impact energy than does heat #4553, despite the fact that the impact toughness test performed on heat #1703 was conducted at a lower temperature compared to heat #4553 (−29° C. vs. +24° C.). These data indicate that high strength and high toughness can be achieved in the steel of the current exemplary embodiments if the proper thermal mechanical treatment is used to create a fine-grained microstructure.

Composition of heat #1703 and heat #4553

| Heat # | C | Cr | Ni | Mn | Mo | Si | V | Nb | Al | Ti |
|---|---|---|---|---|---|---|---|---|---|---|
| 1703 | 0.089 | 10.66 | 2.38 | 0.5 | 0.47 | 0.15 | | | 0.024 | 0.37 |
| 4553 | 0.083 | 10.83 | 2.42 | 0.28 | 0.49 | 0.20 | 0.030 | 0.015 | 0.0384 | 0.38 |

TABLE II

Mechanical properties of bar made from heat #1703 and heat #4553

| Heat # | Yield strength | Ultimate tensile strength | Elongation | Charpy V-notch properties: energy | Charpy V-notch properties: test temperature |
|---|---|---|---|---|---|
| 1703 | 821 MPa | 931 MPa | 18% | 163 J | −29° C. |
| 4553 | 807 MPa | 917 MPa | 14% | 8 J | 24° C. |

Figure 2:
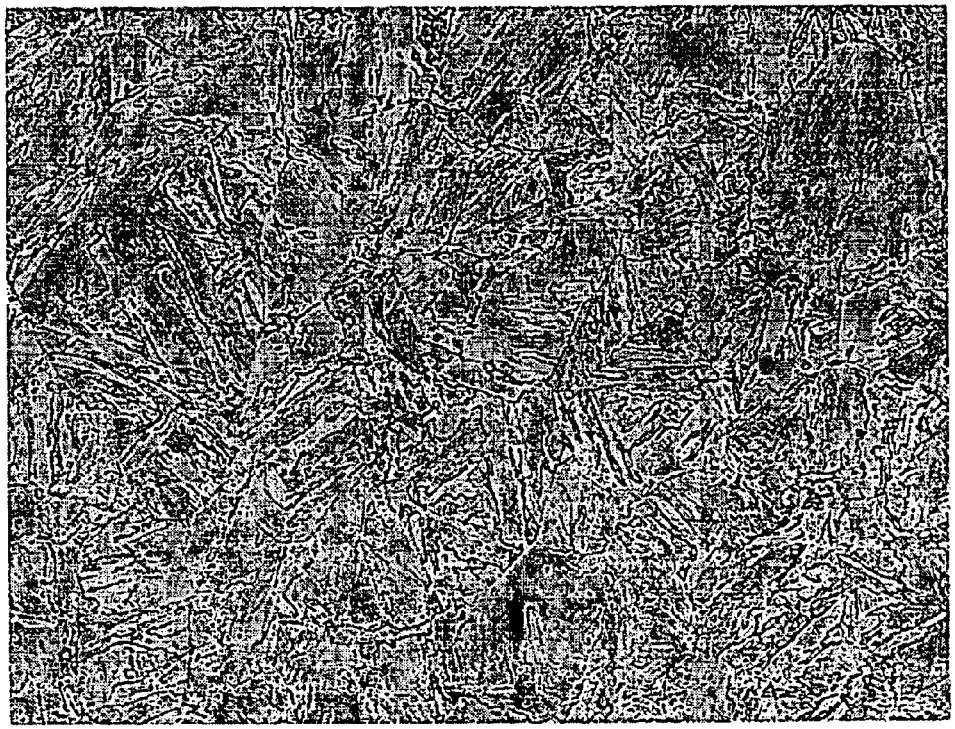
FIG. 2 shows a microstructure (Vilella's etch) for a steel in which a strain was applied during hot working and which has an approximate grain size of ASTM No. 3. The image is magnified at 100×.

FIG. 2 shows a microstructure of steel similar to heat #4553 in which a true strain of less than 15% (0.15) was applied during hot working. The photomicrograph (Vilella's etch) is at a magnification of 100×. The approximate grain size is ASTM No. 3 (coarse grains).

Figure 3:
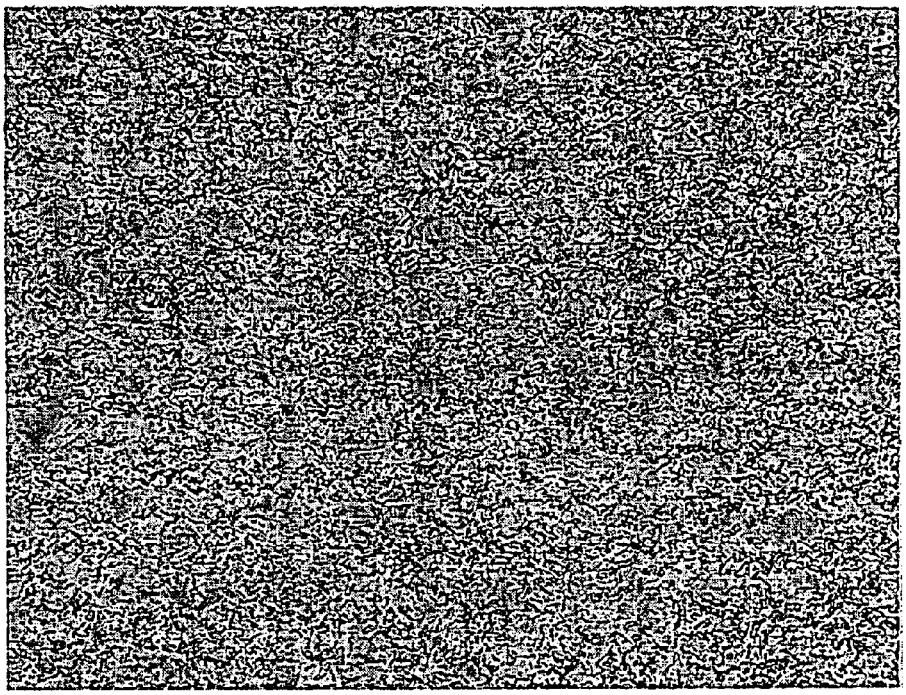
FIG. 3 shows a microstructure (Vilella's etch) for a steel in which a strain greater than that applied in FIG. 2 was applied during hot working and which has an approximate grain size of ASTM No. 10. The image is magnified at 100×.

FIG. 3 shows a microstructure of steel similar to heat #1703 in which a true strain of greater than 15% was applied during hot working. The photomicrograph (Vilella's etch) is at a magnification of 100×. The approximate grain size is ASTM No. 10 (fine grains).

A fine grained iron base alloy has been described in which the ASTM grain size number is greater than or equal to 5, consisting essentially of (wt. %): 0.05<C<0.15; 7.5<Cr<15; 2<Ni<5; Co<4, Cu<1.2; Mn<5; Si<1; (Mo+W)<4; 0.01<Ti<0.75; Zr<1.6; Ta<3.2; Hf<3.2; 0.135<(1.17Ti+0.6Zr+0.31Ta+0.31Hf)<1; N<0.02; Al<0.2; Al and Si both present such that (Al+Si)>0.01; each of B, Ce, Ca, Mg, Sc, Y, La, and Be less than 0.1; P<0.1; S<0.03; each of Sn, Sb, O, Pb and other impurities less than 0.04; and the balance essentially iron. In an exemplary embodiment, the alloy is in a hot worked condition. In an exemplary embodiment, the alloy is in a hot rolled condition and formed into a tubular product. In an exemplary embodiment, the alloy is in a hot worked condition and formed into a tubular product.

A fine-grained iron base alloy has been described in which the ASTM grain size number is greater than or equal to 5, consisting essentially of (wt. %): 0.05<C<0.15; 7.5<Cr<15; 2<Ni<5; Co<4; Cu<1.2; Mn<5; Si<1; (Mo+W)<4; 0.01<Ti<0.75; Zr<1.6; Ta<3.2; Hf<3.2; 0.135<(1.17Ti+0.6Zr+0.31Ta+0.31Hf)<1; V 2; Nb<1; N<0.02; Al<0.2; Al and Si both present such that (Al+Si)>0.01; each of B, Ce, Ca, Mg, Sc, Y, La, and Be less than 0.1; P<0.1; S<0.03; each of Sn, Sb, O, Pb and other impurities less than 0.04; and the balance essentially iron. In an exemplary embodiment, the alloy is in a hot worked condition. In an exemplary embodiment, the alloy is in a hot rolled condition and formed into a tubular product. In an exemplary embodiment, the alloy is in a hot worked condition and formed into a tubular product.

A method of producing a fine-grained iron base alloy has been described that comprises preparing an iron base alloy consisting essentially of (wt. %): 0.05<C<0.15; 7.5<Cr<15; 2<Ni<5; Co<4; Cu<1.2; Mn<5; Si<1; (Mo+W)<4; 0.01<Ti 0.75; Zr<1.6; Ta<3.2; Hf<3.2; 0.135<(1.17Ti+0.6Zr+0.31Ta+0.31 Hf)<1; V<2; Nb<1; N<0.02; Al<0.2; Al and Si both present such that (Al+Si)>0.01; each of B, Ce, Ca, Mg, Sc, Y, La, and Be less than 0.1; P<0.1; S<0.03; each of Sn, Sb, O, Pb and other impurities less than 0.04; and the balance essentially iron; and thermal mechanically treating the iron base alloy by a process comprising: austenitizing the iron base alloy at a temperature above 1000° C.; hot working the alloy at a temperature greater than 1000° C. to impart a true strain of greater than 0.15 (15%); and cooling the alloy to room temperature to obtain a fine-grained martensitic microstructure in which the ASTM grain size number is greater than or equal to 5. In an exemplary embodiment, hot working the iron base alloy comprises hot rolling the iron base alloy at a temperature above about 1000° C. to impart the true strain of greater than 0.15 (15%). In an exemplary embodiment, hot rolling the iron base alloy further comprises forming the iron base alloy into a tubular product. In an exemplary embodiment, hot working the iron base alloy further comprises forming the iron base alloy into a tubular product. In an exemplary embodiment, the method further comprises heat treating the iron base alloy after the iron base alloy is cooled to room temperature and retaining a fine grain size in which the ASTM grain size number is greater than or equal to 5. In an exemplary embodiment, heat treating the iron base alloy after the iron base alloy is cooled to room temperature further comprises tempering the iron base alloy. In an exemplary embodiment, heat treating the iron base alloy after the iron base alloy is cooled to room temperature further comprises austenitizing, quenching and tempering the iron base alloy. In an exemplary embodiment, heat treating the iron base alloy after the iron base alloy is cooled to room temperature further comprises normalizing and tempering the iron base alloy. In an exemplary embodiment, heat treating the iron base alloy after the iron base alloy is cooled to room temperature further comprises normalizing the iron base alloy. In an exemplary embodiment, heat treating the iron base alloy after the iron base alloy is cooled to room temperature further comprises austenitizing and quenching the iron base alloy.

A fine-grained iron base alloy has been described in which the ASTM grain size number is greater than or equal to 5, consisting essentially of within a range of plus or minus 15% of the following nominal amounts (wt. %): 0.09 C, 10.7 Cr, 2.4 Ni, 0.5 Mn, 0.5 Mo, 0.15 Si, 0.024 Al, 0.37 Ti and the balance essentially iron and impurities. In an exemplary embodiment, the iron base alloy is in a hot worked condition. In an exemplary embodiment, the iron base alloy is in a hot rolled condition. In an exemplary embodiment, the iron base alloy is in a hot rolled condition and formed into a tubular product. In an exemplary embodiment, the iron base alloy is in a hot worked condition and formed into a tubular product.

A fine-grained iron base alloy has been described in which the ASTM grain size number is greater than or equal to 5, consisting essentially of (wt. %) about 0.09 C, about 10.7 Cr, about 2.4 Ni, about 0.5 Mn, about 0.5 Mo, about 0.15 Si, about 0.024 Al, about 0.37 Ti, and the balance essentially iron and impurities. In an exemplary embodiment, the iron base alloy is in a hot worked condition. In an exemplary embodiment, the iron base alloy is in a hot rolled condition. In an exemplary embodiment, the iron base alloy is in a hot rolled condition and formed into a tubular product. In an exemplary embodiment, the iron base alloy is in a hot worked condition and formed into a tubular product.

A fine-grained iron base martensitic alloy has been described in which the ASTM grain size number is greater than or equal to 5, consisting essentially of (wt. %): $0.05<C<0.15$; $7.5<Cr<15$; $1<Ni<5$; $Co<10$; $Cu<5$; $Mn<5$; $Si<1.5$; $(Mo+W)<4$; $0.01<Ti<0.75$; $Zr<1.6$; $Ta<3.2$; $Hf<3.2$; $0.135<(1.17\ Ti+0.6\ Zr+0.31\ Ta+0.31\ Hf)<1$; $V<2$; $Nb<1$; $N<0.05$; $Al<0.2$; $(Al+Si)>0.01$; each of B, Ce, Ca, Mg, Sc, Y, La, and Be less than 0.1; $P<0.1$; $S<0.03$; each of Sn, Sb, O, Pb and other impurities less than 0.04; and the balance essentially iron. In an exemplary embodiment, the iron base alloy is in a hot worked condition. In an exemplary embodiment, the iron base alloy is in a hot rolled condition and formed into a tubular product. In an exemplary embodiment, the iron base alloy is in a hot worked condition and formed into a tubular product.

A method of producing a fine-grained iron base alloy has been described that comprises preparing an iron base alloy consisting essentially of (wt. %): $0.05<C<0.15$; $7.5<Cr<15$; $1<Ni<5$; $Co<10$; $Cu<5$; $Mn<5$; $Si<1.5$; $(Mo+W)<4$; $0.01<Ti<0.75$; $Zr<1.6$; $Ta<3.2$; $Hf<3.2$; $0.135<(1.17\ Ti+0.6\ Zr+0.31\ Ta+0.31\ Hf)<1$; $V<2$; $Nb<1$; $N<0.05$; $Al<0.2$; $(Al+Si)>0.01$; each of B, Ce, Ca, Mg, Sc, Y, La, and Be less than 0.1; $P<0.1$; $S<0.03$; each of Sn, Sb, O, Pb and other impurities less than 0.04; and the balance essentially iron; and thermal mechanically treating by austenitizing it at a temperature above 1000° C., hot working the alloy at a temperature greater than 1000° C. to impart a true strain of greater than 0.15 (15%) and cooling the alloy to room temperature to obtain a fine-grained martensitic microstructure in which the ASTM grain size number is greater than or equal to 5. In an exemplary embodiment, the iron base alloy comprises hot rolling the iron base alloy at a temperature above about 1000° C. to impart the true strain of greater than 0.15 (15%). In an exemplary embodiment, hot rolling the iron base alloy further comprises forming the iron base alloy into a tubular product. In an exemplary embodiment, hot working the iron base alloy further comprises forming the iron base alloy into a tubular product. In an exemplary embodiment, the method further comprises heat treating the iron base alloy after the iron base alloy is cooled to room temperature and retaining a fine grain size in which the ASTM grain size number is greater than or equal to 5. In an exemplary embodiment, heat treating the iron base alloy after the iron base alloy is cooled to room temperature further comprises tempering the iron base alloy. In an exemplary embodiment, heat treating the iron base alloy after the iron base alloy is cooled to room temperature further comprises austenitizing, quenching and tempering the iron base alloy. In an exemplary embodiment, heat treating the iron base alloy after the iron base alloy is cooled to room temperature further comprises normalizing and tempering the iron base alloy. In an exemplary embodiment, heat treating the iron base alloy after the iron base alloy is cooled to room temperature further comprises normalizing the iron base alloy. In an exemplary embodiment, heat treating the iron base alloy after the iron base alloy is cooled to room temperature further comprises austenitizing and quenching the iron base alloy.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

I claim:

1. A fine-grained iron base alloy in which the ASTM grain size number is greater than or equal to 5, consisting essentially of (wt. %): $0.05<C<0.15$; $7.5<Cr<15$; $2<Ni<5$; $Co<4$, $Cu<1.2$; $Mn<5$; $Si<1$; $(Mo+W)<4$; $0.01<Ti<0.75$; $Zr<1.6$; $Ta<3.2$; $Hf<3.2$; $0.135<(1.17Ti+0.6Zr+0.31Ta+0.31Hf)<1$; $N<0.02$; $Al<0.2$; Al and Si both present such that $(Al+Si)>0.01$; each of B, Ce, Ca, Mg, Sc, Y, La, and Be less than 0.1; $P<0.1$; $S<0.03$; each of Sn, Sb, O, Pb and other impurities less than 0.04; and the balance essentially iron.

2. The iron base alloy of claim 1, wherein the alloy is in a hot worked condition.

3. The iron base alloy of claim 1, wherein the alloy is in a hot rolled condition and formed into a tubular product.

4. The iron base alloy of claim 1, wherein the alloy is in a hot worked condition and formed into a tubular product.

5. A fine-grained iron base alloy in which the ASTM grain size number is greater than or equal to 5, consisting essentially of (wt. %): $0.05<C<0.15$; $7.5<Cr<15$; $2<Ni<5$; $Co<4$; $Cu<1.2$; $Mn<5$; $Si<1$; $(Mo+W)<4$; $0.01<Ti<0.75$; $Zr<1.6$; $Ta<3.2$; $Hf<3.2$; $0.135<(1.17Ti+0.6Zr+0.31Ta+0.31Hf)<1$; $V<2$; $Nb<1$; $N<0.02$; $Al<0.2$; Al and Si both present such that $(Al+Si)>0.01$; each of B, Ce, Ca, Mg, Sc, Y, La, and Be less than 0.1; $P<0.1$; $S<0.03$; each of Sn, Sb, O, Pb and other impurities less than 0.04; and the balance essentially iron.

6. The iron base alloy of claim 5 wherein the alloy is in a hot worked condition.

7. The iron base alloy of claim 5, wherein the alloy is in a hot rolled condition and formed into a tubular product.

8. The iron base alloy of claim 5, wherein the alloy is in a hot worked condition and formed into a tubular product.

9. A method of producing a fine-grained iron base alloy, comprising:

preparing an iron base alloy consisting essentially of (wt. %): $0.05<C<0.15$; $7.5<Cr<15$; $2<Ni<5$; $Co<4$; $Cu<1.2$; $Mn<5$; $Si<1$; $(Mo+W)<4$; $0.01<Ti<0.75$; $Zr<1.6$; $Ta<3.2$; $Hf<3.2$; $0.135<(1.17Ti+0.6Zr+0.31Ta+0.31Hf)<1$; $V<2$; $Nb<1$; $N<0.02$; $Al<0.2$; Al and Si both present such that $(Al+Si)>0.01$; each of B, Ce, Ca, Mg, Sc, Y, La, and Be less than 0.1; P<0.1; S<0.03; each of Sn, Sb, O, Pb and other impurities less than 0.04; and the balance essentially iron; and thermal mechanically treating the iron base alloy by a process comprising: austenitizing the iron base alloy at a temperature above 1000° C.; hot working the alloy at a temperature greater than 1000° C. to impart a true strain of greater than 0.15 (15%); and cooling the alloy to room temperature to obtain a fine-grained martensitic microstructure in which the ASTM grain size number is greater than or equal to 5.

10. The method of claim 9, wherein hot working the iron base alloy comprises hot rolling the iron base alloy at a temperature above about 1000° C. to impart the true strain of greater than 0.15 (15%).

11. The method of claim 9, wherein hot rolling the iron base alloy further comprises forming the iron base alloy into a tubular product.

12. The method of claim 9, wherein hot working the iron base alloy further comprises forming the iron base alloy into a tubular product.

13. The method of claim 9, further comprising heat treating the iron base alloy after the iron base alloy is cooled to room temperature and retaining a fine grain size in which the ASTM grain size number is greater than or equal to 5.

14. The method of claim 13, wherein heat treating the iron base alloy after the iron base alloy is cooled to room temperature further comprises tempering the iron base alloy.

15. The method of claim 13, wherein heat treating the iron base alloy after the iron base alloy is cooled to room temperature further comprises austenitizing, quenching and tempering the iron base alloy.

16. The method of claim 13, wherein heat treating the iron base alloy after the iron base alloy is cooled to room temperature further comprises normalizing and tempering the iron base alloy.

17. The method of claim 13, wherein heat treating the iron base alloy after the iron base alloy is cooled to room temperature further comprises normalizing the iron base alloy.

18. The method of claim 13, wherein heat treating the iron base alloy after the iron base alloy is cooled to room temperature further comprises austenitizing and quenching the iron base alloy.

19. A fine-grained iron base martensitic alloy in which the ASTM grain size number is greater than or equal to 5, consisting essentially of (wt. %): 0.05<C<0.15; 7.5<Cr<15; 1<Ni<5; Co<10; Cu<5; Mn<5; Si<1.5; (Mo+W)<4; 0.01<Ti<0.75; Zr<1.6; Ta<3.2; Hf<3.2; 0.135<(1.17Ti+0.6Zr+0.31 Ta+0.31 Hf)<1; V<2; Nb<1; N<0.05; Al<0.2; (Al+Si)>0.01; each of B, Ce, Ca, Mg, Sc, Y, La, and Be less than 0.1; P<0.1; S<0.03; each of Sn, Sb, O, Pb and other impurities less than 0.04; and the balance essentially iron.

20. The iron base alloy of claim 19, wherein the iron base alloy is in a hot worked condition.

21. The iron base alloy of claim 19, wherein the iron base alloy is in a hot rolled condition and formed into a tubular product.

22. The iron base alloy of claim 19, wherein the iron base alloy is in a hot worked condition and formed into a tubular product.

23. A method of producing a fine-grained iron base alloy that comprises preparing an iron base alloy consisting essentially of (wt. %): 0.05<C<0.15; 7.5<Cr<15; 1<Ni<5; Co<10; Cu<5; Mn<5; Si<1.5; (Mo+W)<4; 0.01<Ti<0.75; Zr<1.6; Ta<Hf<3.2; 0.135<(1.17 Ti+0.6 Zr+0.31 Ta+0.31 Hf)<1; V<2; Nb<1; N<0.05; Al<0.2; (Al+Si)>0.01; each of B, Ce, Ca, Mg, Sc, Y, La, and Be less than 0.1; P<0.1; S<0.03; each of Sn, Sb, O, Pb and other impurities less than 0.04; and the balance essentially iron; and thermal mechanically treating by austenitizing it at a temperature above 1000° C., hot working the alloy at a temperature greater than 1000° C. to impart a true strain of greater than 0.15 (15%) and cooling the alloy to room temperature to obtain a fine-grained martensitic microstructure in which the ASTM grain size number is greater than or equal to 5.

24. The method of claim 23, wherein hot working the iron base alloy comprises hot rolling the iron base alloy at a temperature above about 1000° C. to impart the true strain of greater than 0.15 (15%).

25. The method of claim 23, wherein hot rolling the iron base alloy further comprises forming the iron base alloy into a tubular product.

26. The method of claim 23, wherein hot working the iron base alloy further comprises forming the iron base alloy into a tubular product.

27. The method of claim 23, further comprising heat treating the iron base alloy after the iron base alloy is cooled to room temperature and retaining a fine grain size in which the ASTM grain size number is greater than or equal to 5.

28. The method of claim 27, wherein heat treating the iron base alloy after the iron base alloy is cooled to room temperature further comprises tempering the iron base alloy.

29. The method of claim 27, wherein heat treating the iron base alloy after the iron base alloy is cooled to room temperature further comprises austenitizing, quenching and tempering the iron base alloy.

30. The method of claim 29, wherein heat treating the iron base alloy after the iron base alloy is cooled to room temperature further comprises normalizing and tempering the iron base alloy.

31. The method of claim 27, wherein heat treating the iron base alloy after the iron base alloy is cooled to room temperature further comprises normalizing the iron base alloy.

32. The method of claim 27, wherein heat treating the iron base alloy after the iron base alloy is cooled to room temperature further comprises austenitizing and quenching the iron base alloy.

* * * * *